US007798363B2

(12) United States Patent
Brandon

(10) Patent No.: US 7,798,363 B2
(45) Date of Patent: Sep. 21, 2010

(54) METHOD AND APPARATUS FOR TINTING CAULK

(75) Inventor: Larry Brandon, Pryor, OK (US)

(73) Assignee: Red Devil, Inc., Tulsa, OK (US)

( * ) Notice: Subject to any disclaimer, the term of this patent is extended or adjusted under 35 U.S.C. 154(b) by 397 days.

(21) Appl. No.: 11/808,718

(22) Filed: Jun. 12, 2007

(65) Prior Publication Data

US 2007/0242558 A1 Oct. 18, 2007

Related U.S. Application Data

(63) Continuation of application No. 10/382,648, filed on Mar. 7, 2003, now abandoned.

(51) Int. Cl.
*B67B 7/00* (2006.01)
*B65D 88/54* (2006.01)

(52) U.S. Cl. ..... 222/1; 222/156; 222/327; 366/143; 366/256

(58) Field of Classification Search ..... 222/325–327, 222/41, 156–158, 321.1, 321.7, 1; 366/143, 366/256

See application file for complete search history.

(56) References Cited

U.S. PATENT DOCUMENTS

| | | | | |
|---|---|---|---|---|
| 1,998,692 | A | 4/1935 | Harrison et al. | |
| 3,195,778 | A | 7/1965 | Edwin | |
| 4,131,715 | A * | 12/1978 | Frankel | 428/413 |
| 4,948,016 | A | 8/1990 | Summons et al. | |
| 5,044,758 | A | 9/1991 | Kurtz | |
| 6,223,952 | B1 | 5/2001 | Woodford | |
| 6,302,575 | B1 | 10/2001 | Anderson et al. | |
| 6,454,129 | B1 | 9/2002 | Green | |
| 6,681,957 | B1 | 1/2004 | Green | |
| 6,910,799 | B2 | 6/2005 | Renfro | |
| 7,070,318 | B2 | 7/2006 | Renfro | |
| 2002/0065353 | A1 | 5/2002 | Anderson et al. | |
| 2002/0154568 | A1 | 10/2002 | Renfro | |
| 2006/0151531 | A1 | 7/2006 | Tikusis | |

OTHER PUBLICATIONS

Industrial Edition 2001 Do-It-Yourself Retailers Choice Award—"MixAll Caulk Coloring Mixing System" product information (believed to be dated prior to Dec. 2002).

"MixAll Colorants Acrylics" product information (believed to be dated prior to Dec. 2002).

(Continued)

*Primary Examiner*—Kevin P Shaver
*Assistant Examiner*—Melvin A Cartagena
(74) *Attorney, Agent, or Firm*—Venable LLP; Clifton E. McCann; Steven J. Schwarz

(57) ABSTRACT

A caulk product is provided. The product comprises an amount of caulk that is formulated so as to be white in color prior to curing and clear after curing. A cylindrical cartridge contains the amount of caulk, wherein the cartridges comprises a dispensing tip, a substantially cylindrical body, a removable and replaceable endcap, and a breakable seal located between the tip and the body. A transparent area is disposed within a wall of the cartridge so as to allow the color of the caulk to be viewed, wherein the area defined by the cartridge body is adapted to accommodate the insertion of colorant and a mixing tool without overflow. A related method for coloring caulk is also provided.

16 Claims, 2 Drawing Sheets

OTHER PUBLICATIONS

Red Devil Catalog No. 36, 1983.

Red Devil Catalog No. 37, 1987.

DAP Technical Bulletin for DAP Alex Plus Acrylic Latex Caulk Plus Silicone, revised Jul. 11, 2002.

DAP Inc., Material Safety Data Sheet, Publish Feb. 2, 1996, Revised Dec. 27, 1999, p. 4.

M. Harrell, "Local mans's invention gains national attention," Elizabethtown Star, Oct. 22, 2002.

Pages from Phenoseal website.

* cited by examiner

METHOD AND APPARATUS FOR TINTING CAULK

CROSS REFERENCE TO RELATED APPLICATIONS

This application is a continuation of U.S. application Ser. No. 10/382,648, filed Mar. 7, 2003.

BACKGROUND OF THE INVENTION

1. Field of the Invention

The present invention relates generally to methods and apparatus for mixing and dispensing caulking compounds and more particularly to tinting caulking compound that has been dispensed into prepackaged containers to match a selected color of paint.

2. Related Art

Caulking compounds are used to join, for example, wood or synthetic trim to painted surfaces; laminates at their seams or to walls; sinks to counters; flooring to painted, laminated or wood surfaces; and so on. Caulking compounds are generally used to caulk joints where a waterproof seal is needed in the joint and which can be subsequently painted if necessary. Most caulking compounds are generally white or off-white tending toward a gray color which is the natural color of most caulking compounds, although some limited quantities of black or special order quantities of colors are available. The colored compounds, i.e. those other than white, cannot generally be commercially obtained except in very large quantities upon special order from the manufacturer. The reasons for this is that there is not a great deal of a demand for large quantities of particular colors of colored caulking compounds and it is therefore impractical for a caulking compound manufacturer to produce large quantities of tinted caulking compounds having various colors and shades.

Therefore, such tinted caulking compounds are generally not available for small users such as home owners and smaller commercial construction companies whose volume of use is not sufficient to warrant special orders of a particular tinted color of caulking compound. There is a desire, however, on the part of the purchasing public to have caulking compounds of various colors.

In the use of certain materials such as caulking or other sealing materials which are sold in plastic dispensing tubes such as LIFETIME® Adhesive Sealant, it is often desirable to color the material to match, e.g., the wall color being applied to a room. For example, in the use of conventional white caulking material, as soon as the material sets up sufficiently, usually about two hours or longer, the material can be painted the same color as the room. Where the paint is of a light shade in particular, it may be difficult to cover the material completely without multiple paint coats. Also, it is often necessary to do some additional caulking after the final coat of paint is applied. In that event, the white caulking is painted over as the final step. The advantage of having color matched caulk is that a great saving of time is possible. The user does not have to apply the paint itself with precision at joining edges or, alternatively, does not have to paint over white caulk previously applied. The user may first paint next to, but not exactly on, the joint and then afterwards fill in the unpainted surface with caulk.

Consequently, some paint dealers have undertaken to mix colorant into the caulking material by hand for certain customers, but considerable time and effort is involved and often results in inferior mixing and considerable clean up time. The problem is that, unlike paint, caulk is very viscous. Therefore, there are problems in mixing the tinting agent with the caulk and in dispensing the caulk into the tubes which are used in caulk guns, since it cannot readily be poured. There is presently no economical means available of supplying this needed product since manufacturers of the caulking compounds cannot maintain sufficient variety of inventory or small quantities of caulking compound to suit the consumer needs.

Thus, there is a need for an apparatus and method which allows the contractor or the home hobbyist to purchase tubes of caulk and add colorant to the caulk to duplicate the color of their paint, tile, laminate, or the like. There is also a need for a quick, effective, convenient and cleaner method and apparatus for substantially automatically performing the mixing operation.

BRIEF SUMMARY OF THE INVENTION

A method for tinting caulk is provided. In an exemplary embodiment of the invention, the method comprises: providing an amount of caulk, wherein the caulk is white in color prior to curing and clear after curing; providing a cylindrical cartridge to contain the caulk, wherein the cartridge comprises a substantially cylindrical body, having a dispensing end and a fill end, a removable and replaceable end-cap adapted to be received in the fill end, a dispensing tip coupled to the dispensing end, and a breakable seal located between the tip and the body, and wherein the body is sufficiently clear throughout its length so as to allow the color of caulk contained within the cartridge to be viewed; providing a mixing tool having a mixer head means having seal means adapted to be brought into static engagement with wall portions of the body adjacent the fill end to lock the head means to the body and to prevent leakage of the caulk from the body during a mixing operation, bore means formed thru the seal means substantially on a longitudinal axis of the body, elongated shaft means mounted thru the bore means for both rotational and axial motion relative to the seal means and the body, the shaft means having a proximal end lying axially outwardly of the seal means and having a distal end lying within the body, mixer impeller means mounted on the distal end and having peripheral portions adapted to lie closely adjacent to an inner surface of the body, power means for rotating the shaft means and impeller means relative to the cartridge; filling the cartridge with the caulk to a level sufficient to allow room for the shaft of the mixing tool to be inserted into the cartridge without causing caulk to overflow from the cartridge; adding coloration for the caulk comprising an amount of paint having the desired color of the caulk, or in the alternative, where paint of the desired color is unavailable, adding color tint corresponding to the desired color of caulk, along with an amount of white paint; affixing the mixing tool to the fill end of the body, when the end-cap is not in place, such that the shaft of the mixing tool is disposed within the cartridge and such that the seal means of the tool sealingly engages the fill end of the body; applying force to the shaft of the mixing tool such that the colorant and caulk in the cartridge is mixed; breaking the seal between the tip and the body of the cartridge; sealingly engaging the end-cap to the fill end of the cartridge; and applying the tinted caulk to an intended substrate.

In another embodiment of the invention, a caulk product is provided. The product comprises an amount of caulk that is formulated so as to be white in color prior to curing and clear after curing. A cylindrical cartridge contains the amount of caulk, wherein the cartridge comprises a dispensing tip, a substantially cylindrical body, a removable and replaceable end-cap, and a breakable seal located between the tip and the body. A transparent area is disposed within a wall of the cartridge so as to allow the color of the caulk to be viewed, wherein the area defined by the cartridge body is adapted to accommodate the insertion of colorant and a mixing tool without overflow.

In a further embodiment, the amount of caulk contained in the cartridge is selected so that the caulk occupies no more than 95% of the total volume capacity of the area defined by the cartridge body, seal, and end-cap when the end-cap is in place.

In a further embodiment, the transparent area extends the length throughout the length of the cartridge.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Embodiments of the present invention concern a method and apparatus for mixing any of a wide variety of liquid or particulate materials such as colorant, e.g., pigment or organic dye, sand, grout, catalyst for two-part caulking, or the like, preferably in solution or suspension form, into viscous work material, particularly caulking compound, wherein the structural mixing components are of unique but simple design and are adapted to accomplish the mixing very rapidly and directly within the work material retail container, i.e., in-situ.

Figure 1:
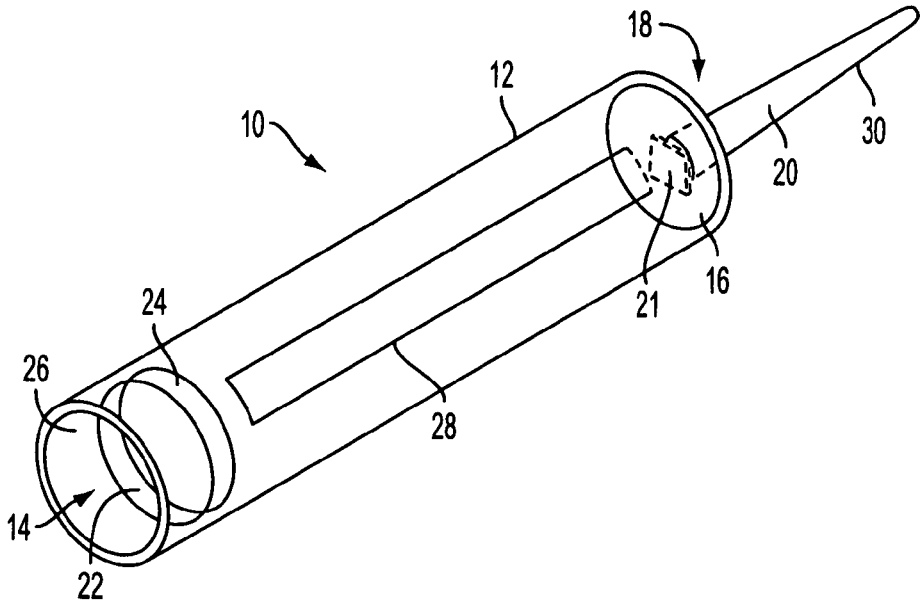
FIG. 1 depicts a perspective view of a materials container in cartridge form according to an exemplary embodiment of the present invention.

In FIG. 1, an embodiment of the present invention is shown as a caulking tube or container 10 in the form of an elongated tubular housing 12 which is preferably cylindrical in shape, but which could take a variety of cross-section geometric shapes, if desired. Tubular housing 12 has a generally hollow interior 14 that is closed at one end, a dispensing end, by an end wall 16 including a nozzle assembly 18, as is known in the art. Nozzle assembly 18 includes an elongated dispensing tip 20. Housing 12 is enclosed at an end opposite end wall 16, a fill end, by a end cap 22 which is slideably received in interior 14 so that it has a peripheral edge surface 24 that abuts the interior surface 48 of surrounding side wall 26 that forms tubular housing 12. As described more thoroughly below, at least a portion of side wall 26 is transparent.

Figure 2:
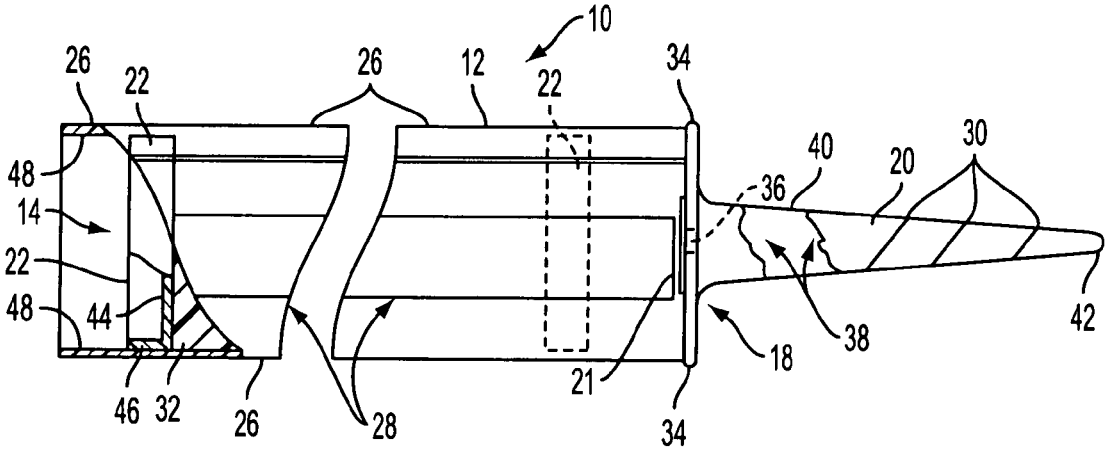
FIG. 2 depicts a side view in elevation, in partial cross-section and broken away, of the cartridge of FIG. 1.

The construction of container 10 is shown in greater detail in FIG. 2. As is shown in FIG. 2, container 10 receives a caulking compound 32 which is preferably opaque and, in one embodiment, consists of an acrylic terpolymer including ethylacryate, acrylonitrile, and acrylic acid which physically vulcanizes by immobilization into a clear substance. The caulking compound is also preferably greater than 60% solids. The caulking compound is tintable such that the caulk is colored by the addition of a colorant. Housing 12 is enclosed at the dispensing end by end wall 16 which, in one embodiment, is in the form of a metal cap having a lip 34 that is secured onto the edge of housing 12 as is known in the art. End wall 16 has a central port 36, shown in phantom, and is provided with nozzle assembly 18 that includes elongated tip 20. Tip 20 has a passageway 38 extending longitudinally therethrough with tip 20 being somewhat conical in shape so that side wall 40 of tip 20 diminishes in cross-section from end wall 16 to free end 42 of tip 20. Passageway 38 is in fluid communication with the interior 14 of housing 12, but a seal 21 interrupts this fluid communication. Prior to use, however, seal 21 is broken to establish the outlet path for the compound 32. The provision of seal 21 allows for more complete mixing of the caulk in the container, as described below.

In the illustrated embodiment, an end cap 22 seals the caulking material in the interior 14 of the housing 12. The end cap 22 is removable so that colorant can be mixed with the caulk in the housing 12. As mentioned above, at least a portion of the housing 12 is sufficiently clear so that the color of the caulk contained within the interior 14 can be viewed. The housing 12 may be clear along its entire length. A label including product information may be applied to the side wall 26. The label may include a window 28 extending along the length of the housing 12, through which the color of the caulk can be viewed. The user can also observe through the window or through the clear housing if the colorant is uniformly mixed and distributed throughout the caulk.

The end cap 22 can be replaced on the housing after the colorant is added and can act as a piston member slideably received in the open interior 14 of housing 12. As is shown in FIG. 2, end cap 22 is cup-shaped in configuration so that it has a flat base plate 44 which bears against caulking material 32. To this end, end cap 22 has a side wall 46 which slideably engages interior surface 48 of side wall 26. Accordingly, the outer surface of side wall 46 defines peripheral surface 24 which slideably engages surface 48.

It should thus be appreciated that, when tip 30 is severed at a selected location along its length, a circular or oval outlet is formed for caulking material 32 since passageway 38 is in fluid communication with hollow interior 14 through port 36 in end wall 16. Accordingly, when end cap 22 is forcibly moved from the upstream location shown in FIG. 2 to the downstream location shown in phantom in FIG. 2, caulking material 32 is expelled as a rope-like bead from the outlet formed in tip 20. This rope-like bead has dimensions which correspond to the dimensions of the outlet. Since surrounding side wall 26 is transparent, the material which remains in cartridge 10 is defined by the position of base plate 44.

A mixing apparatus that may be used to mix the colorant with the caulk is described in co-pending U.S. patent application Ser. No. 10/293,850, which is incorporated herein by reference. With reference to the embodiments shown in FIGS. 3 and 4, the mixing apparatus in its generic sense comprises mixer head means of metal or plastic material and generally designated 50 having a housing end seal means generally designated 52 adapted to be brought into static engagement by pressure cap means generally designated 54 with wall portions such as the top rim 56 of the interior or outer surfaces of the fill end of the housing 12 to prevent leakage of the caulking material from the housing 12 during the mixing operation. Bore means 58 is formed thru the seal means 52 substantially on a longitudinal axis 60 of the housing, and an elongated mixer shaft means 62 is mounted thru 58 for both rotational and axial motion with respect to the seal means 52 and housing 12. This shaft means 62 has a proximal end 64 lying axially outwardly of the seal means and has a distal end 66 lying within the interior 14. Mixer impeller means 68 is mounted on the distal end 66 and has a periphery 70 adapted to lie closely adjacent to or in sliding contact with cylindrical inner surface 48 of the tube. The above seal means 52, bore means 58, shaft means 62, impeller means 58 and pressure cap means 54 constitute the basic structure of the head means 50. Power means may also be provided for rotating the shaft 62 and impeller 68 as they are being moved axially thru the caulking material.

Figure 3:
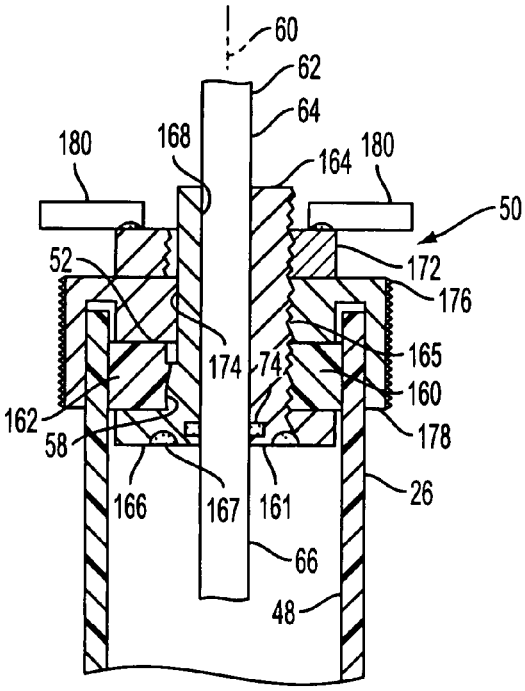
FIG. 3 depicts a longitudinal cross-section view of a mixer apparatus according to an exemplary embodiment of the present invention.
Figure 4:
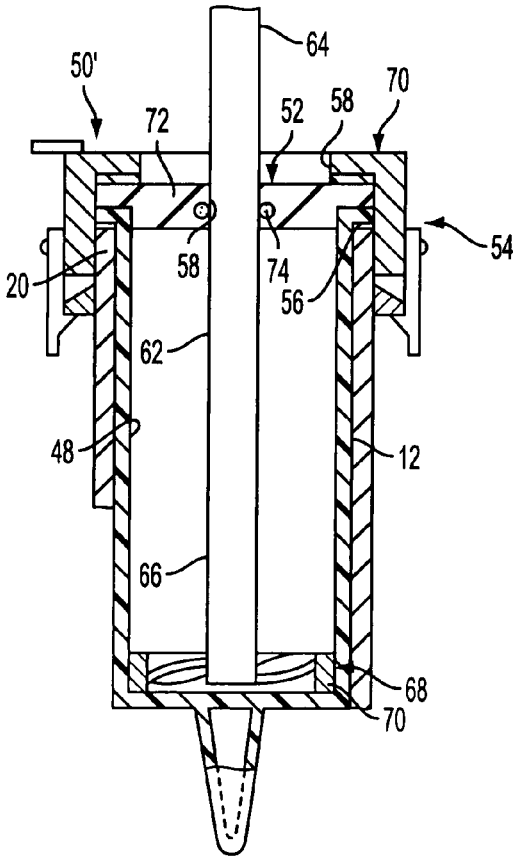
FIG. 4 depicts a cross-section view of the proximal end of the cartridge and a mixing head including a cartridge holder.

In the embodiment shown in FIGS. 3 and 4 the pressure cap means 54 includes a pressure cap section 70. In the embodiment of FIG. 4, when pressure cap section 70 is forced down onto the seal means 52, the seal means 52 will seal the housing 12.

Shaft means 62 is rotatably mounted through seal body 72 in the embodiment shown, which body is preferably provided with a mixer shaft seal 74 such as an O-ring or other annular ring type seal of composition and configuration which affords an axially sliding seal as well as one which wipes the viscous material from the shaft while reciprocating in the caulking tube.

The upper or proximal end 64 of the shaft preferably is mounted through a rotative power means which can rotate the shaft 64 selectively and substantially instantly in either direction and at any desired rpm, e.g. 600-800 rpm, such that maximum mixing turbulence can be imparted to the work material. Alternatively, the shaft can be reciprocated through the housing by hand, as is described in more detail below.

In FIG. 4 the seal means 52 comprises an elastomeric gripping body 160 having a circular periphery 162 which is dimensioned in diameter to slide down into the end of the housing 12. A bushing 164 having threads 165 is axially mounted thru bore 58 in body 160 and has its inner end 161 non-rotatably fixed to a plate 166 as by welding at 167. Shaft 62 is rotatably, slidably mounted thru a bore 168 in the bushing.

In use, shaft 62 is mounted thru bore 168 with the mixer impeller lying adjacent plate 166. With the mixer impeller then inserted into a tube through the fill end thereof, body 160 is slid into the fill end to a desired position therein. Bushing 164 may be provided with a flat 174 over which a pressure cap 176 of special configuration is mounted. This cap is dimensioned and shaped to slide down over bushing 164 and the open neck 163 of a tube and be held by hand from rotating while nut 172 is tightened against the upper surface 169 of the cap to bulge seal body 160. The outer cylindrical wall 178 of the cap prevents excessive outward bulging of the tube neck wherein such bulging might be a problem for some tubes having thin or weak walls. Torque arms 180 on nut 172 allow hand tightening thereof. Nut 172 is tightened sufficiently to bulge the body 160 radially outwardly to seal and grip against inner surface 48 of the housing 12. The elastomeric material of body 160 is selected to allow it to sealingly bulge under just a few pounds of pressure from the tightening nut 172.

With the seal means 52 and mixer impeller means thus positioned in the tube, and with the colorant injected, e.g., deposited in the tube, on or into the work material by drop bottles, syringe, spatula, gel capsules, color packets, mechanical dispenser, or the like, the tube can be hand held or placed within a holder or carriage, and the shaft 62 rotated either by a power means such as an electric drill having its chuck fixed to 62. Reciprocation of the mixer head through the work material relative to the caulking tube can be done by power means or by hand to thoroughly mix the colorant and the caulk.

Figure 5:
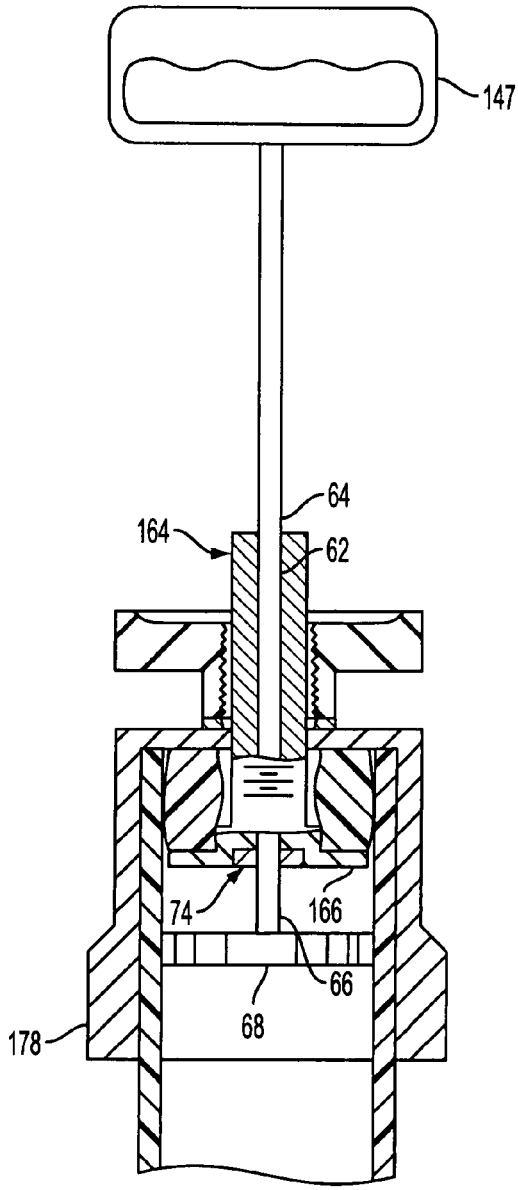
FIG. 5 depicts a cross-section view of a mixer apparatus according to another embodiment of the invention.

In another embodiment of the invention illustrated in FIG. 5, shaft 62 is provided with a handle 147 by which a user can reciprocate shaft 62 and impeller 68 without having to rotate the shaft 62 to mix the colorant and the caulk.

Accordingly, the caulking tubes and mixing apparatus described above may be using in a method for tinting caulk. The general procedure for tinting the caulking compound in the preprepared packages of caulking tubes is to first remove the end-cap 22 and add the colorant to the caulk in the housing. It is preferred that the size of the interior of the housing and the amount of caulk provided in the housing are selected to allow the colorant to be added without overflow from the housing. Typically, a standard size housing is filled with about 9.4 ounces of caulk. If there is not sufficient volume in the housing to permit the addition of tinting material, some caulk is removed before adding the colorant. However, care must be taken not to remove too much caulk from the housing. If the total volume of the caulk applied to the substrate is more than about 5% colorant, the quality of the caulk is degraded to a commercially meaningful extent. Preferably, the caulk is about 3% to about 4% colorant. The colorant and the caulk are then mixed, for example with the use of the above-described mixing apparatus. The end cap is replaced and the tinted caulk is dispensed from the tube.

In an exemplary method of the invention, an amount of caulk is provided in a container, for example a caulking tube as described above. The caulking tube should include a transparent portion through which the color of the caulk can be observed. In one embodiment, the tube is substantially opaque as to allow brand information, manufacturer information, and product information to be displayed thereon, except for a transparent window that extends throughout the length of the tube. Also, a seal is provided between the interior of the housing and the dispensing tip. The seal prevents caulk from entering the dispensing tip during mixing, such that the colorant can be evenly mixed through all of the caulk. The caulk may be of a type that is initially opaque or white in color prior to curing and clear after curing. When color is added to the caulk, the caulk takes on the color of the colorant after curing.

The end cap 22 is removed from the container, allowing the colorant to be added to the caulk. Typically a tube contains about 9.4 ounces of caulk. About 7.5 to 10 ml of colorant is used to color this amount of caulk. The cartridge is filled with the caulk to a level sufficient to allow room for colorant and the shaft of the mixing tool to be inserted into the cartridge without causing caulk to overflow the cartridge. The colorant for the caulk may comprise an amount of paint having the desired color of the caulk, or in the alternative, where paint of the desired color is unavailable, a color tint corresponding to the desired color of the caulk. If necessary, an amount of white paint may be added to the caulk to fine tune its color. Of course, any other kind of colorant that is compatible with the caulk may be used to color the caulk.

A mixing tool having a shaft, such as the mixing apparatus described above, is also provided. The mixing tool is affixed to the end of the cartridge with the end-cap removed, such that the shaft of the mixing tool is disposed within the cartridge and such that the circumference of the base of the tool sealingly engages the end of the cartridge. A rotational force is applied to the shaft of the mixing tool such that the colorant and caulk in the cartridge are mixed together. The rotational force may be generated by an electric drill having its chuck affixed to the shaft, by hand, or by other motive force. The shaft may also be reciprocated through the housing. In a hand-operated embodiment, the shaft is rotated as it is reciprocated through the housing, for example, in a screw-like manner.

If a hand-operated mixer is used, the following method may be used to tint the caulk. The shaft 62 and impeller 68 are inserted all the way down into the housing 12 through the caulk such that impeller 68 is proximate end 18. The shaft 62 and impeller 68 are withdrawn to fill end of the housing, whereby air that was originally entrained in the caulk escapes. The shaft 62 and impeller 68 are reciprocated within the housing between the fill end and the dispensing end about 10-50 times, whereby the colorant is mixed into the caulk.

After mixing, the mixing apparatus is removed from the housing 12 and the end-cap 22 is sealingly engaged to the end of the housing. The seal between the dispensing tip and the interior of the housing is broken, allowing the caulk to pass out of the housing. The tinted caulk can then be dispensed from the container in a manner know in the art and applied to an intended substrate.

Accordingly, an apparatus and method which allows the contractor or the home hobbyist to purchase tubes of caulk and add colorant to the caulk to duplicate the color of their paint, tile, laminate, or the like is provided. There is also provided a quick, effective, convenient and cleaner method and apparatus for substantially automatically performing the mixing operation.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, with the scope of the claims and their equivalents, the invention may be practiced otherwise than as specifically described.

What is claimed is:

1. A method for coloring caulk, comprising:

providing a cylindrical cartridge containing caulk that is clear after curing, wherein the cartridge comprises a substantially cylindrical body defining an interior housing the caulk, a dispensing tip coupled to the body, and a removable and replaceable end-cap sealing the caulk in the body, and wherein at least a portion of the body is sufficiently clear so as to allow the color of caulk contained within the cartridge to be viewed;

removing the end-cap from the body;

adding paint of a desired color to the caulk, wherein the amount of paint does not, when combined with the caulk, exceed about 5% of the total combined volume of the caulk and paint; and mixing the paint and the caulk, wherein the color of the caulk becomes substantially the same as the desired color.

2. The method of claim 1 wherein the clear portion of the body extends substantially the entire length of the body and wherein the method further comprises observing a color change of the caulk through the clear portion of the body.

3. The method of claim 1 wherein the mixing is accomplished via hand power.

4. The method of claim 1 wherein the body further comprises a breakable seal located between the dispensing tip and the interior and wherein the method further comprises breaking the seal between the tip and the interior of the cartridge.

5. A method for matching the color of a caulk to the color of an intended substrate to which the caulk is to be applied, comprising:

providing a cylindrical cartridge containing caulk that is clear after curing, wherein the cartridge comprises a substantially cylindrical body defining an interior housing the caulk and at least a portion of the body is sufficiently clear so as to allow the color of caulk contained within the cartridge to be viewed;

adding an amount of paint to the caulk to match the color of the caulk to the intended substrate, wherein the paint is substantially the same color as the substrate and the amount of paint does not, when combined with the caulk, exceed about 5% of the total combined volume of the caulk and paint;

mixing the paint and the caulk;

observing the color of the caulk through the clear portion of the body; and applying the caulk to the intended substrate.

6. The method of claims 1 or 5, wherein the caulk is opaque prior to curing.

7. A method for coloring caulk a color that is substantially the same as a desired color, comprising selecting a caulk that is clear after curing, selecting an amount of paint of the desired color, and mixing the paint and caulk, wherein the amount of paint does not, when combined with the caulk, exceed about 5% of the total combined volume of the caulk and paint.

8. The method of claim 7, further comprising the step of measuring the amount of paint such that the amount, when combined with the caulk, is from about 3% to about 4% of the total combined volume of the caulk and paint.

9. The method of claim 7, further comprising the step of selecting the caulk so that it is opaque prior to curing.

10. The method of claim 7, further comprising the step of selecting the caulk so that it consists of greater than 60% solids.

11. The method of claim 6, further comprising the step of selecting the caulk so that it consists of an acrylic terpolymer.

12. The method of claim 11, further comprising the step of selecting the caulk so that it consists of an acrylic terpolymer selected from the group consisting of ethacrylate, acrylonitrile and acrylic acid.

13. A method for coloring caulk, comprising:

providing a cylindrical cartridge containing caulk that is clear after curing, wherein the cartridge comprises a substantially cylindrical body defining an interior that houses the caulk, a dispensing tip coupled to the body, and a removable end-cap capable of sealing the caulk in the body, and wherein at least a portion of the body is sufficiently clear so as to allow the color of caulk contained within the cartridge to be viewed;

adding paint of a desired color to the caulk, wherein the amount of paint does not, when combined with the caulk, exceed about 5% of the total combined volume of the caulk and paint; and mixing the paint and caulk, wherein the color of the caulk becomes substantially the same color as the desired color.

14. The method of claim 13, wherein the clear portion of the body extends substantially the entire length of the body and wherein the method further comprises observing a color change of the caulk through the clear portion of the body.

15. The method of claim 13, wherein the body further comprises a breakable seal located between the dispensing tip and the interior and wherein the method further comprises breaking the seal after said mixing step.

16. The method of claim 1, 5, 8, or 13, wherein the caulk is white prior to curing.

* * * * *